US008451132B1

(12) United States Patent
Van Vleet

(10) Patent No.: US 8,451,132 B1
(45) Date of Patent: May 28, 2013

(54) PORTABLE HEAT AND SMOKE DETECTION SYSTEM

(76) Inventor: William Van Vleet, Mondovi, WI (US)

( * ) Notice: Subject to any disclaimer, the term of this patent is extended or adjusted under 35 U.S.C. 154(b) by 271 days.

(21) Appl. No.: 12/788,493

(22) Filed: May 27, 2010

(51) Int. Cl.
*G08B 17/12* (2006.01)

(52) U.S. Cl.
USPC ..... 340/577; 340/584; 340/628; 340/630; 340/508; 340/506

(58) Field of Classification Search
USPC ..... 340/577, 58, 584, 628, 630, 508, 340/506, 7
See application file for complete search history.

(56) References Cited

U.S. PATENT DOCUMENTS 4,160,246 A * 7/1979 Martin et al. ..... 340/630
4,363,031 A 12/1982 Reinowitz
D275,936 S 10/1984 Coyer
4,570,155 A 2/1986 Skarman et al.
5,905,438 A * 5/1999 Weiss et al. ..... 340/636.1
5,949,332 A * 9/1999 Kim ..... 340/539.27
6,624,750 B1 9/2003 Marman et al.
6,690,288 B1 2/2004 Waddell
7,939,804 B2 * 5/2011 Schmidt ..... 250/338.5
2006/0289175 A1 12/2006 Gutowski et al.
2009/0009346 A1 1/2009 Hojmose et al.

* cited by examiner

*Primary Examiner* — Tai T Nguyen
(74) *Attorney, Agent, or Firm* — Dale J. Ream

(57) ABSTRACT

The portable heat and smoke detection system includes a detecting means that is portable and remotely located with respect to an alarming means. The alarming means informs the end user to the detection of smoke, fire, or carbon monoxide via the detecting means. The detecting means may or may not include a light and audible alarm; whereas the alarming means may include a light, audible alarm, cellular telephoning capability, text messaging capability, and/or an e-mail capability.

5 Claims, 4 Drawing Sheets

PORTABLE HEAT AND SMOKE DETECTION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of heat and smoke detectors, more specifically, a heat and smoke detector that is portable located respective of the alarming means.

B. Discussion of the Prior Art

As a preliminary note, it should be stated that there is an ample amount of prior art that deals with smoke and heat detection systems. As will be discussed immediately below, no prior art discloses a heat and smoke detector that is portably located with respect to the alarming means, and of which has a plurality of alarming means for an end user to select.

The Gutowski et al. Patent Application Publication (U.S. Publication No. 2006/0289175) discloses a portable wireless system and method for detection and automatic suppression of fires. However, the system and method include automatic system that can remotely signal an alarming means to alert an end user to the presence of smoke and/or carbon monoxide and/or a fire.

The Hojmose et al. Patent Application Publication (U.S. Publication No. 2009/0009346) discloses a portable personal alarm device comprising a manually activable switch means, a smoke and/or gas detector means, a vibration and/or tilt detection means, and audible and/or visible alarm indication means. However, the detection means are not remotely located with respect to the alarming means.

The Marman et al. Patent (U.S. Pat. No. 6,624,750) discloses a wireless home fire and security alarm system. However, the system is not designed for portable applications wherein the detecting means can be placed anywhere and can remotely signal the alarming means to the presence of smoke and/or carbon dioxide and/or fire.

The Skarman et al. Patent (U.S. Pat. No. 4,570,155) discloses a smoke alarm activated light that includes a strobe circuit. Again, the system is not designed for portable applications wherein the detecting means can be placed anywhere and can remotely signal the alarming means.

The Reinowitz Patent (U.S. Pat. No. 4,363,031) discloses a wireless smoke alarm system in which each detector includes a local smoke detector and alarm. However, the alarm system is not for portable applications.

The Waddell Patent (U.S. Pat. No. 6,690,288) discloses an emergency response system including a smoke detector and an evacuation guide. However, the detecting means are not portable and remotely located respective of the alerting means.

The Coyer Patent (U.S. Pat. No. Des. 275,936) illustrates an ornamental design for a portable smoke house, which does not depict an alarming means remote of the smoke house.

While the above-described devices fulfill their respective and particular objects and requirements, they do not describe a heat and smoke detector that is portably located with respect to the alarming means, and of which has a plurality of alarming means for an end user to select. In this regard, the portable heat and smoke detection system departs from the conventional concepts and designs of the prior art.

SUMMARY OF THE INVENTION

The portable heat and smoke detection system includes a detecting means that is portable and remotely located with respect to an alarming means. The alarming means informs the end user to the detection of smoke, fire, or carbon monoxide via the detecting means. The detecting means may or may not include a light and audible alarm; whereas the alarming means may include a light, audible alarm, cellular telephoning capability, text messaging capability, and/or an e-mail capability.

It is an object of the invention to provide a smoke/heat/carbon monoxide detector that is portable.

A further object of the invention is to provide an alerting means that is remote with respect to the detector.

A further object of the invention is to provide a heat/smoke/carbon monoxide detection system that can provide a plurality of alarming means comprising text messaging, e-mail, telephone, light, audible sound.

These together with additional objects, features and advantages of the portable heat and smoke detection system will be readily apparent to those of ordinary skill in the art upon reading the following detailed description of presently preferred, but nonetheless illustrative, embodiments of the portable heat and smoke detection system when taken in conjunction with the accompanying drawings.

In this respect, before explaining the current embodiments of the portable heat and smoke detection system in detail, it is to be understood that the portable heat and smoke detection system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable heat and smoke detection system.

It is therefore important that the claims be regarded as including such equivalent construction insofar as they do not depart from the spirit and scope of the portable heat and smoke detection system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A portable heat and smoke detection system 10 (hereinafter invention) includes a detecting means 11 and an alarming means 12.

The main feature of the invention 10 is the ability to place the detecting means 11 in a location that is remote of the alarming means 12. Furthermore, a secondary feature of the invention 10 is to provide a detecting means that is highly portable.

The detecting means 11 includes a housing 11A, at least one sensor 11B, and may include a light 11C.

The sensor 11B may be able to detect the presence of smoke, fire, and/or carbon dioxide. The sensor(s) 11B are in communication with a central processing unit 11D (hereinafter CPU). The CPU 11D is in communication with a transmitter 11E. Electrical energy is supplied to the CPU 11D, which in turn supplies electricity to the transmitter 11E, the light indicator 11C, and sensor(s) 11B. Electrical energy is supplied to the CPU 11D via a powering means comprising a power cord 11F or at least one battery 11G. The battery(s) 11G shall be contained within a battery compartment 11H.

The CPU 11D, the transmitter 11E, the battery compartment 11H, and the sensor(s) 11B are located on or in the housing 11A. The housing 11A includes a plurality of vents 11A' that enable operation of the sensor(s) 11B located therein.

The alarming means 12 includes a receiver 12A, a light indicator 12B, and an alarm 12C. The receiver 12A receives signals transmitted from the transmitter 11E, and emits the alarm 12C and/or illuminates the light indicator 12B. Said signals transmitted from the transmitter 11E are wireless.

The receiver 12A, the light indicator 12B, and the alarm 12C are included within a housing.

Figure 1:
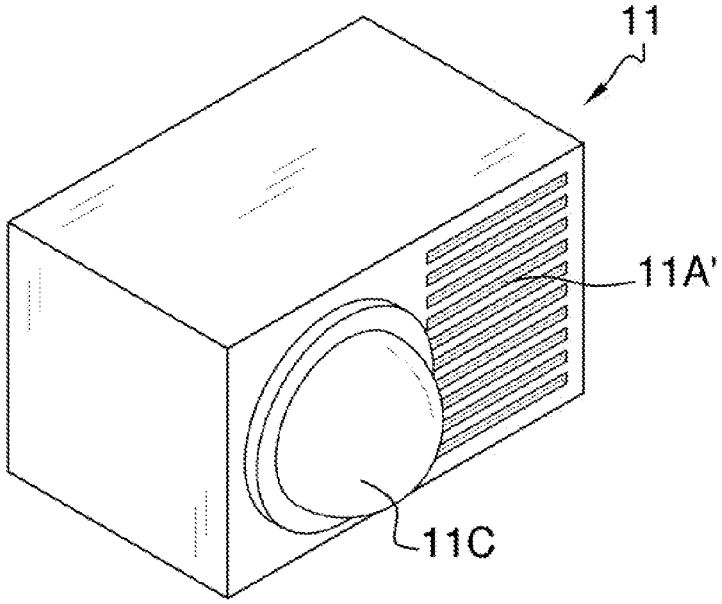
FIG. 1 illustrates a front, isometric view of the detecting means, which includes a light and sensor.
Figure 2:
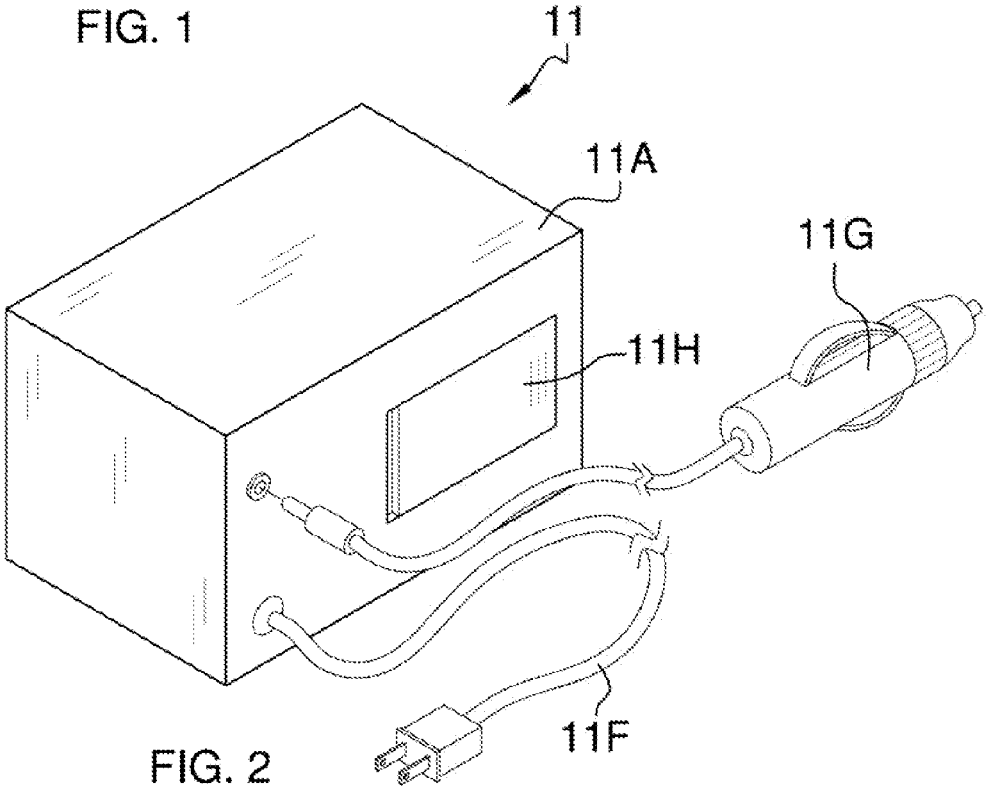
FIG. 2 illustrates a rear, isometric view of the detecting means of the portable heat and smoke detection system, and depicting the power cord and battery compartment located thereon.
Figure 3:
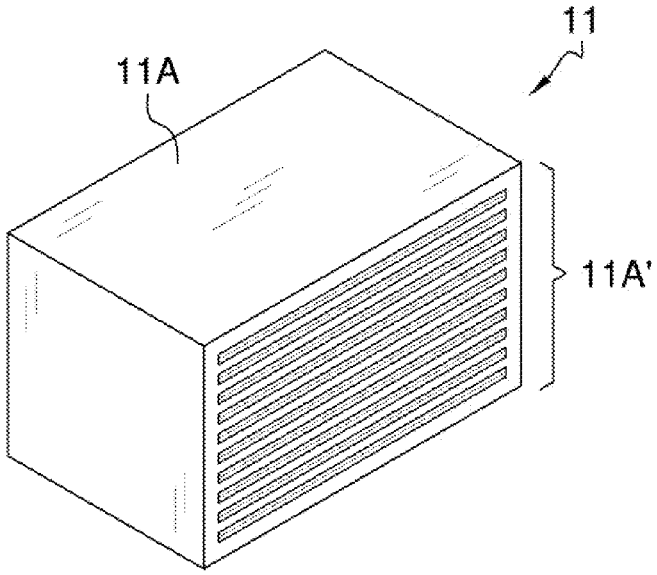
FIG. 3 illustrates a front, isometric view of the detecting means without a light.
Figure 4:
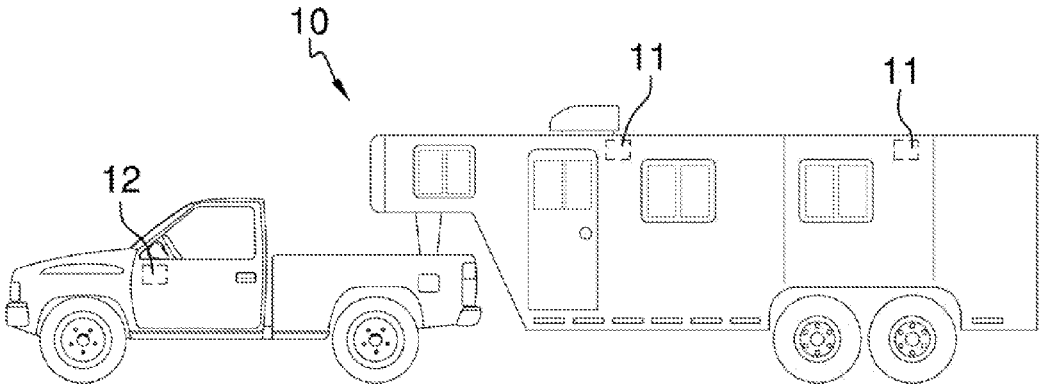
FIG. 4 illustrates a view of the portable heat and smoke detection system in use, wherein a plurality of detecting means are placed within an RV and an alarming means is located within a truck cab.
Figure 5:
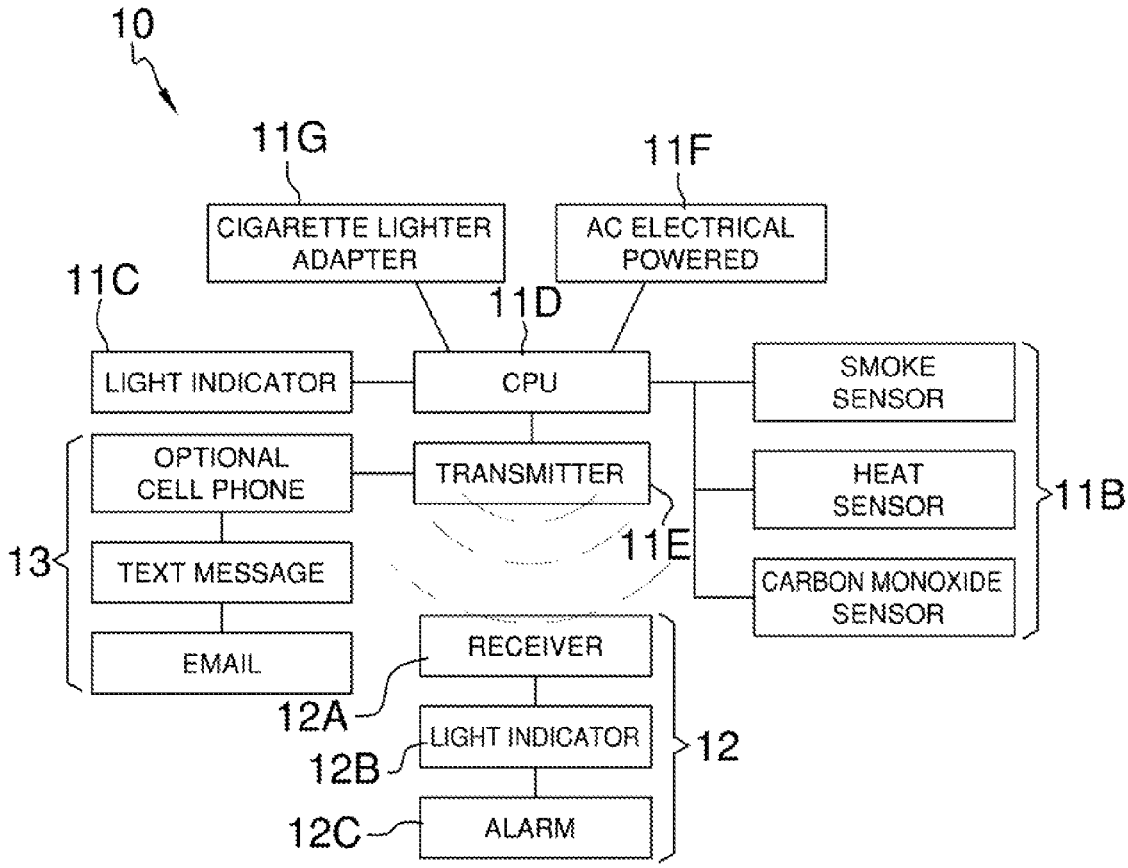
FIG. 5 illustrates a block diagram of the various components and features of the portable heat and smoke detection system.
Figure 6:
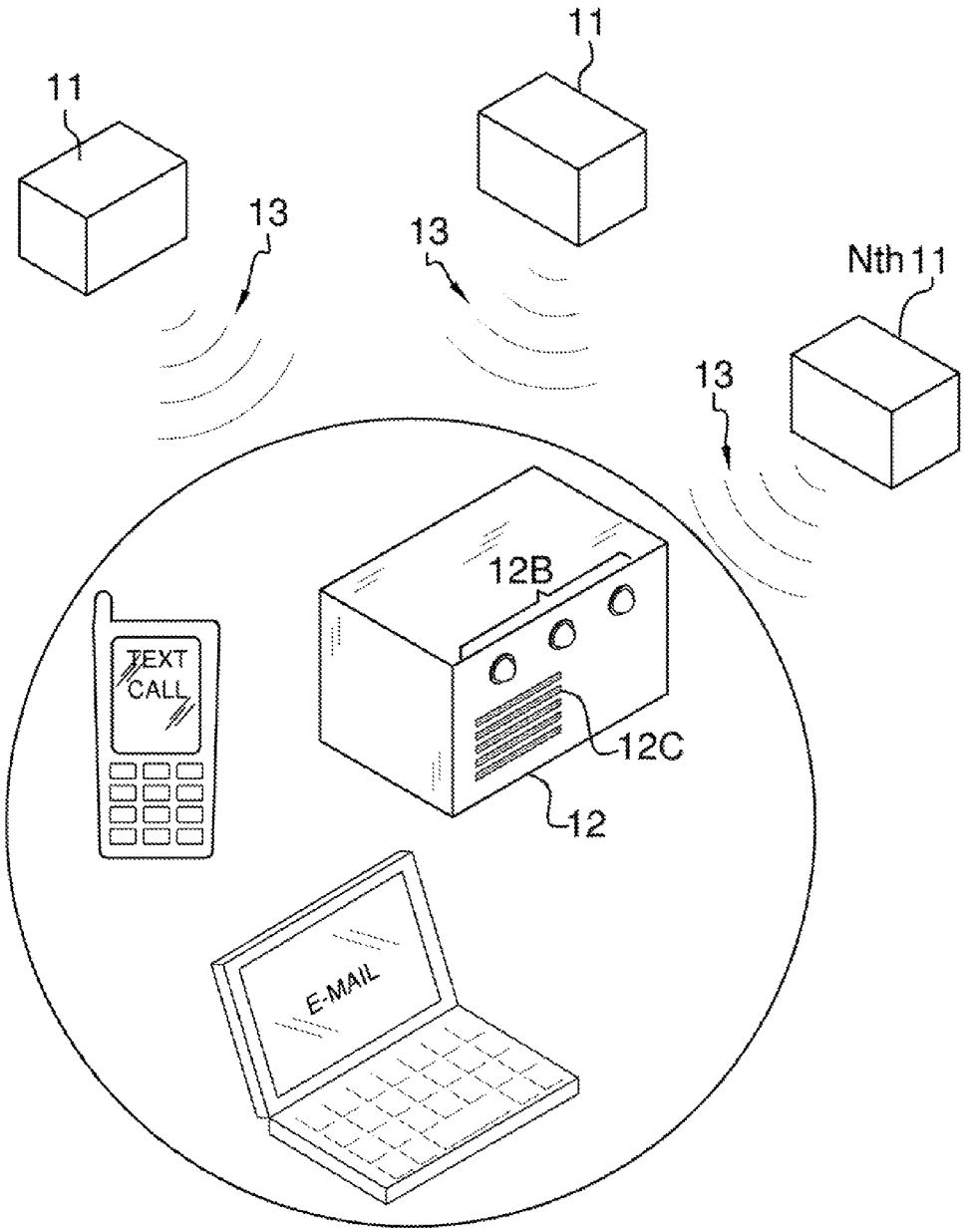
FIG. 6 illustrates a plurality of detecting means in communication with the alarming means, which in turn is in communication with a computer or cellular telephone.

The transmitter 11E may communicate with the receiver 12A and/or communicate via other alarming means 13 comprising cellular telephoning, text messaging, or e-mailing (see FIG. 6). However, it shall be noted that the incorporation of these alarming means may require the use of a cellular services (3G, e.g.) or Wi-Fi hardware in order to provide such alarming means. Furthermore, it shall be noted that the alarming means 13 may communicate to a computer via e-mail or to a cellular telephone via a text message.

It shall be further noted that there may be a plurality of detecting means 11 in sync with one another and communicating to the alarming means 13 (see FIG. 6).

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable smoke detection system for use in detecting a fire event in a recreational vehicle being towed behind a truck and for communicating detection thereof to occupant of the truck, comprising:

a plurality of detecting means, each detecting means including a housing situated in the recreational vehicle;

an alarming means remote from said detecting means, the alarming means including a receiver and an alarm;

wherein each detecting means includes:

a central processing unit;

a transmitter electrically connected to the central processing unit, the transmitter configured to transmit a signal into the air;

a powering means electrically connected to the central processing unit;

a smoke sensor, a heat sensor, and a carbon monoxide sensor situated in the detecting means housing and electrically connected to the central processing unit;

a light electrically connected to the central processing unit;

wherein:

the housing includes a plurality of vents configured to enable operation of the smoke, heat, and carbon monoxide sensors;

the detecting means central processing unit is configured to activate the transmitter to transmit a signal when one of the smoke, heat, and carbon monoxide sensors detects a predetermined condition; and the alarming means receiver is configured to actuate said alarming means alarm when a signal from the transmitter is received.

2. The portable smoke detection system as described in claim 1 wherein the powering means comprises an automobile battery power adapter.

3. The portable smoke detection system as described in claim 1 wherein the smoke, heat, and carbon monoxide sensors are configured to detect a presence of smoke, fire, and/or carbon monoxide, respectively.

4. The portable smoke detection system as described in claim 1 wherein the alarming means includes a light indicator.

5. The portable smoke detection system as described in claim 1 wherein the transmitter can provide an alerting means further comprising a cellular telephoning, text messaging, and/or e-mailing.

* * * * *